US007214055B2

(12) United States Patent
Meister et al.

(10) Patent No.: US 7,214,055 B2
(45) Date of Patent: May 8, 2007

(54) COLINEAR BURNER

(75) Inventors: Ronald J. Meister, Bradford, PA (US); Charles J. Duke, Duke Center, PA (US)

(73) Assignee: Zippo Manufacturing Company, Bradford, PA (US)

( * ) Notice: Subject to any disclaimer, the term of this patent is extended or adjusted under 35 U.S.C. 154(b) by 0 days.

(21) Appl. No.: 10/974,775

(22) Filed: Oct. 28, 2004

(65) Prior Publication Data

US 2005/0100848 A1 May 12, 2005

Related U.S. Application Data

(60) Provisional application No. 60/519,144, filed on Nov. 10, 2003.

(51) Int. Cl.
*F23D 14/58* (2006.01)
*F23D 14/46* (2006.01)

(52) U.S. Cl. ..... 431/349; 431/350; 431/354

(58) Field of Classification Search ..... 431/349, 431/350, 351, 352, 353, 354, 355, 277
See application file for complete search history.

(56) References Cited

U.S. PATENT DOCUMENTS

| | | | |
|---|---|---|---|
| 718,714 | A | 1/1903 | Larson |
| 1,054,188 | A | 2/1913 | Ehmann |
| 1,309,049 | A | 7/1919 | Syrett |
| 1,435,747 | A | 11/1922 | Seiling |
| 2,631,579 | A | 3/1953 | Metzger |
| 2,734,364 | A | 2/1956 | Peterson |
| 2,759,345 | A | 8/1956 | Peterson |
| 3,149,623 | A | 9/1964 | Orr, Jr. |
| 3,330,204 | A | 7/1967 | Little |
| 3,450,025 | A | 6/1969 | Fleming |
| D243,436 | S | 2/1977 | Vida |
| 4,109,567 | A | 8/1978 | Gage et al. |
| 4,178,844 | A | 12/1979 | Ward et al. |
| D256,316 | S | 8/1980 | Nichols, Jr. |
| 4,466,788 | A | 8/1984 | Nitta |
| 4,475,528 | A | 10/1984 | Kuchenbrod |
| 4,553,523 | A | 11/1985 | Stohrer, Jr. |

(Continued)

FOREIGN PATENT DOCUMENTS

EP 1 452 264 * 10/1976

(Continued)

*Primary Examiner*—Alfred Basichas
(74) *Attorney, Agent, or Firm*—Faegre & Benson LLP

(57) ABSTRACT

A convertible burner for gas-fueled cigarette pocket lighters for use with flint and wheel ignition, the burner including a burner body having a central gas fuel passageway and an air inlet channel in fluid communication with the central passageway and may have a plurality of integrally formed passageways around the periphery of the burner body. An air control structure in the form of a collar is movable to a first position with respect to the burner body to close the air inlet channel and form a post-mix burner for flint and wheel ignition, and to a second position with respect to the burner body to admit air via the air inlet channel to form a pre-mix burner after ignition. The relative movement can be longitudinal or peripheral, and the peripheral movement can be circumferential. In one embodiment, the collar surrounds and is immediately adjacent to the air inlet channel.

33 Claims, 8 Drawing Sheets

U.S. PATENT DOCUMENTS

| | | | |
|---|---|---|---|
| 4,589,399 | A | 5/1986 | Hamill et al. |
| 4,920,950 | A | 5/1990 | Johnson |
| 4,929,174 | A | 5/1990 | Wang |
| 4,977,824 | A | 12/1990 | Shinler |
| 5,055,034 | A | 10/1991 | Wang |
| 5,133,333 | A | 7/1992 | Stout |
| 5,287,844 | A | 2/1994 | Fieber |
| 5,308,240 | A | 5/1994 | Lowenthal |
| 5,310,336 | A | 5/1994 | Segawa |
| 5,452,706 | A | 9/1995 | Meza |
| D370,387 | S | 6/1996 | Dorvall et al. |
| 5,584,681 | A | 12/1996 | Suzuki |
| 5,713,344 | A | 2/1998 | Gilbert |
| 5,716,204 | A | 2/1998 | Mifune et al. |
| 6,015,286 | A | 1/2000 | Maruyama |
| 6,131,560 | A | 10/2000 | Healy |
| 6,135,014 | A | 10/2000 | Chang |
| 6,135,761 | A | 10/2000 | Chen |
| 6,279,467 | B1 | 8/2001 | Tiemann |
| 6,457,594 | B1 | 10/2002 | Tiemann |
| 6,537,062 | B1 | 3/2003 | Wong |
| 6,546,851 | B1 | 4/2003 | Osborne |
| 6,558,156 | B2 | 5/2003 | Wong |
| 6,681,759 | B2 | 1/2004 | Bentulan |
| 6,773,258 | B1 | 8/2004 | Wong |
| 6,780,006 | B1 | 8/2004 | Wong |
| 6,827,572 | B2 | 12/2004 | Wong |
| 6,884,063 | B2 | 4/2005 | Wong |
| 6,905,329 | B2 | 6/2005 | Wong |
| 2002/0187446 | A1 | 12/2002 | Wong |
| 2002/0197579 | A1 | 12/2002 | Wong |
| 2004/0096793 | A1 | 5/2004 | Wong |
| 2004/0202978 | A1* | 10/2004 | Wong ..... 431/344 |

FOREIGN PATENT DOCUMENTS

| | | | |
|---|---|---|---|
| GB | 2 216 244 | A | 10/1989 |
| GB | 2 259 755 | A | 3/1993 |

* cited by examiner

COLINEAR BURNER

CROSS REFERENCE TO RELATED APPLICATION

This application claims the benefit of U.S. Provisional Application No. 60/519,144, filed Nov. 10, 2003, the entire contents of which are incorporated by reference.

FIELD OF INVENTION

The present invention relates to cigarette or pocket lighters generally, and specifically to pocket lighters with flint and striking wheel ignition.

BACKGROUND OF THE INVENTION

There are two primary types of gas-fueled pocket lighters presently available. The first type of gas-fueled device utilizes a post-mix burner. Post-mix burners pull oxygen for combustion from the air surrounding the gas outlet. This combustion type is characterized by a low velocity, low temperature yellow flame sometimes referred to as a traditional or lazy flame.

A second type of gas-fueled device is a pre-mix burner. This type of burner pulls oxygen for combustion through holes in the base of the burner and combines the oxygen and fuel prior to combustion. This combustion type is characterized by a high velocity, blue flame. These burners, by virtue of their improved efficiency, provide higher flame temperatures, and more complete combustion. The devices are commonly referred to as blue flame, torch flame, or invisible flame, lighting devices.

There are two primary ignition systems that are typically used with gas-fueled cigarette or pocket lighters. The first type is the flint and wheel ignition mechanism. A hardened striking wheel is rotated against a flint made of a pyrophoric material. The engagement of the striking wheel with the flint produces a spark that ignites the fuel as it leaves the gas outlet. Another type of ignition system is piezoelectric. In this type of ignition system, a high voltage charge is generated when a crystal is struck. A spark is created when this charge jumps across a preset gap between an electrical contact and the gas nozzle (which is constructed of a conductive material). This spark ignites the gas as it leaves the nozzle.

The pre-mix burners offer advantages over post-mix burners including better efficiency of combustion, higher heat, and higher velocity, which makes the flame more stable and less likely to be blown out by the wind. The flint and wheel type ignition offers some advantages over piezoelectric ignition systems including being more reliable and consistent, and less costly to produce. Attempts to combine the pre-mix burner with flint and wheel ignition have met the following difficulties. Because of the velocity of the pre-mix burner, it is difficult to ignite the air/fuel mixture with flint and wheel type ignition systems. Also, the dust and debris generated by the flint and wheel ignition system has a tendency to accumulate and clog the air orifices and the gas orifice on the pre-mix burner.

To overcome the above drawbacks, devices have been developed to incorporate a dual i.e., separate burner approach in combination with the flint and wheel ignition. These devices generally offer the following features. First, the device can provide both a post-mix and a pre-mix flame from the same device or lighter, but using separate burners. Some of these devices utilize a flint and striking wheel and others use piezoelectric ignition. In addition, some devices ignite one burner and then utilize the existing flame to ignite the other burner. The dual burner approach suffers from drawbacks including increased complexity, and therefore increases the cost with an adverse effect on reliability. Accordingly, what is needed is a gas operated pocket lighter that combines a single burner capable of operating as a pre-mix burner along with the flint and wheel ignition system.

SUMMARY OF THE INVENTION

The present invention meets the above-described need by combining the functions and features of a pre-mix and post-mix burner into a single burner. When used in conjunction with a flint and wheel ignition, the ignition cycle is staged so that the post-mix burner is ignited first. Once ignition occurs, the post-mix flame is converted to a pre-mix flame in the second stage. Because a single convertible burner is used, there is no need for redundant components or parallel gas delivery systems. The conversion from pre-mix to post-mix burner for ignition is accomplished by closing the air supply orifices to the burner. Conversely, the conversion from the post-mix configuration to the pre-mix configuration is accomplished by opening the air supply for the pre-mix mode of the burner. Furthermore, it has been found that the conversion from post-mix to pre-mix may be accomplished quite rapidly, while still maintaining reliable post-mix ignition and subsequent pre-mix combustion.

In one aspect the present invention includes a convertible burner for a gaseous fuel lighter having a burner body assembly having central passageway therethrough. The gaseous fuel is preferably butane or a similar fuel, capable of storage in the lighter as a liquid, while changing to a gas phase for combustion. The fuel may include one or more alkane hydrocarbons, such as butane alone or a combination of butane and propane. The burner body may have a plurality of peripheral passageways located about the periphery thereof. A burner body assembly may include the burner body and a housing supporting the burner body, with the housing having at least one air inlet channel in fluid communication with the central passageway. The burner also includes a collar surrounding at least a part of the burner body assembly having the air inlet channel. The burner body assembly and the collar are relatively movable with respect to each other to selectively block and unblock fluid communication between the air inlet channel and the external air environment. The burner is convertible between a post-mix configuration when the fluid communication is blocked and a pre-mix configuration when the fluid communication is unblocked. In one aspect of the present invention, the central passageway has a longitudinal axis and the relative movement between the burner body assembly and the collar is colinear with the longitudinal axis. A flint and wheel ignition system is used with the convertible burner to ignite a post-mix flame which the convertible burner then transforms into a pre-mix flame with the same burner.

In another aspect, the present invention may include a method of using a flint and wheel ignition system to ignite a flame in a single burner of a lighter in the post-mix configuration and then transforming the burner to the pre-mix configuration. The method may include the steps of providing the burner body having the central passageway therethrough and may include providing the plurality of peripheral passageways at a periphery of the burner body, and at least one air inlet channel. The method may also include surrounding at least the part of the burner body or burner body assembly which has the air inlet channels with the collar. In the first relative position between the collar and the burner body, the burner is in the post-mix configuration wherein the collar blocks air from entering the central passageway and the plurality of air inlet channels. Ignition using the flint and wheel occurs in the post-mix configuration, with fuel passing through the central passageway not mixed with air until after the fuel exits the burner body. A further step in the method of operation may include causing a second relative position between the collar and the burner body wherein the collar permits air to enter the central passageway and the plurality of air inlet channels such that the burner body and collar form a pre-mix configuration. In the pre-mix configuration, fuel passing through the central passageway is mixed with air before exiting the burner body.

In another aspect, the present invention may include a method of making a flint and wheel ignited single burner for a gaseous fuel lighter, with the burner capable of operating initially in the post-mix configuration during ignition and then transforming to pre-mix configuration. The method may include the steps of providing the burner body assembly having at least the burner body, with the assembly having a central passageway therethrough. A part of the burner body assembly has at least one air inlet channel in fluid communication with the central passageway, and the method may further include providing a collar sized to closely interfit with at least the part of the burner body assembly having the at least one air inlet channel, and assembling the burner body assembly and the collar together in a loose-fitting relationship so that the burner body assembly is movable relative to the collar after assembly. In this aspect, the burner can selectively block air in the external air environment from passing through the at least one air inlet channel to mix with fuel in the central passageway when the burner body assembly and collar are in a first relative position during which ignition is accomplished by the flint and wheel ignition system. Furthermore, the burner can thereafter selectively admit air from the external air environment through the at least one air inlet channel to mix with fuel in the central passageway when the burner body assembly and collar are in a second relative position.

BRIEF DESCRIPTION OF THE DRAWINGS

The invention is illustrated in the drawings in which like reference characters designate the same or similar parts throughout the figures of which.

DETAILED DESCRIPTION

Figure 1:
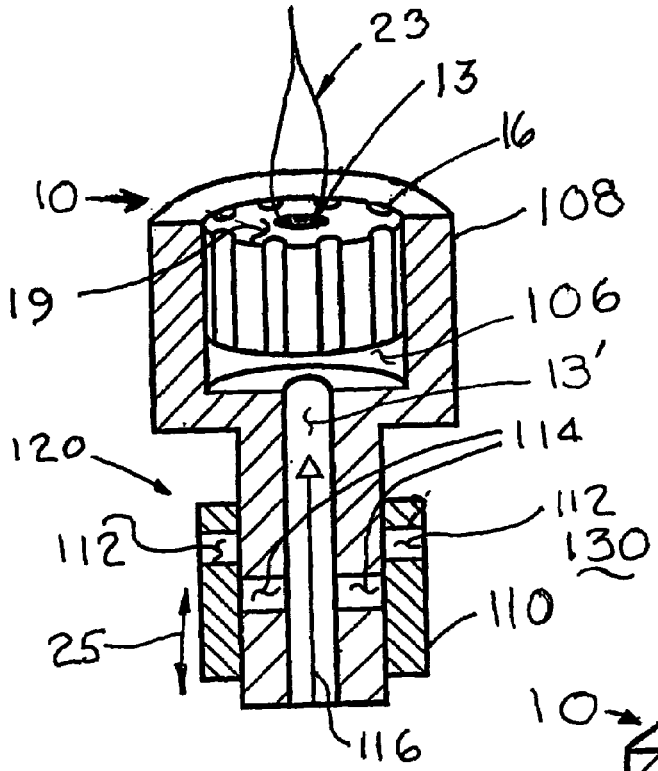
FIG. 1 is a simplified view partly in section of a first embodiment of the burner in a post-mix configuration.

Referring to the Figures and most particularly to FIG. 1, the burner 10 of the present invention includes a centrally disposed gas fuel passageway 13 surrounded by a plurality of peripheral passageways 16. The centrally disposed gas fuel passageway 13 is disposed in the center of a burner body 19 that is constructed of a suitable material. The peripheral passageways 16 are integrally formed about the perimeter of the burner body 19 which is shown in a round configuration. It will be evident to those of ordinary skill that other shapes for the body 19 may also be suitable such as square, rectangular, etc.

The central passageway 13 is in fluid communication with and includes an extension 13' in a housing 108 holding the burner body 19. Central passageway 13 is in fluid communication with a valved fuel reservoir (not shown) that typically contains a combustible fuel such as butane (or a similar fuel) under pressure to keep the fuel in the liquid phase in the reservoir. It is to be understood that the passageway 13 in the burner body 19 and the extension 13' in the housing together constitute an overall central passageway. The operation of the reservoir will be evident to those of ordinary skill in the art, and therefore is not discussed in detail herein. Once the fuel exits the reservoir, it changes to the gas phase, and travels through passageway 13, exiting where the flame 23 is shown in FIG. 1. A flint and wheel igniter system, which may be of the type disclosed in U.S. Pat. No. 6,247,920 (assigned to the assignee of the present invention and the entire contents of which are incorporated herein by reference), is used to ignite the gaseous fuel as it exits the passageway 13. The flint and wheel ignition system will be described in more detail in connection with FIGS. 12 and 13. The burner 10 is mounted such that the opening of passageway 13 is disposed in operative relation to the flint such that sparks from the flint are capable of igniting the gas as it exits passageway 13. The burner assembly of the burner body 19 and housing 108 has at least one air inlet channel 114 in fluid communication with central passageway 13, more particularly, with the extension 13' of passageway 13.

In the configuration of a first position 120 shown in FIG. 1, the burner 10 operates as a post-mix burner because the air inlet channels 114 are closed off by a collar 110. The flint and striking wheel combination ignites the gas exiting the passageway 13 and draws oxygen from the air surrounding the exit to produce a post-mix or yellow flame 23. While the passageways 16 are shown open to a plenum 106 upstream of the burner body 19 in FIG. 1, it is to be understood that the gaseous fuel will propagate through and be ignited at the outlet of passageway 13 in burner body 19, but not through passageways 16 in the post-mix configuration of position 120 shown in FIG. 1.

Figure 2:
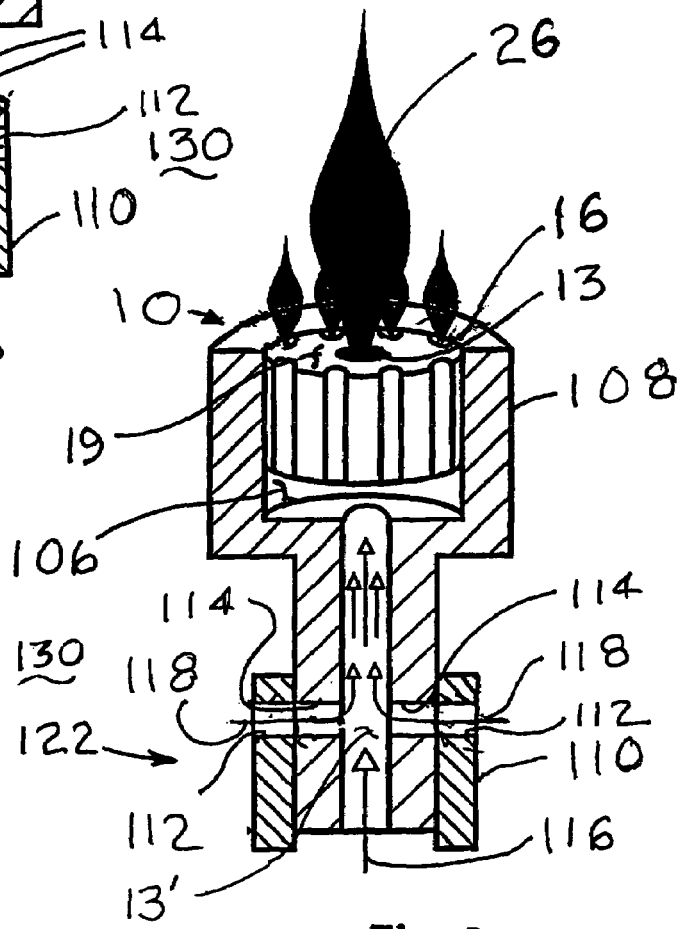
FIG. 2 is a view similar to that of FIG. 1, except with the burner in a pre-mix configuration.

The collar 108 slides back and forth between the positions shown in FIGS. 1 and 2 along a longitudinal axis indicated by arrows 25. The longitudinal axis is defined by the central passageway 13 and is parallel to arrow 116 which represents the fuel flow through central passageway 13.

Turning to FIG. 2, when the collar 108 is moved to a second position 122, one or more air inlet apertures 112 in collar 110 are aligned with air inlet channels 114, providing fluid communication therebetween and to an external ambient air environment 130 such that air can enter along arrows 118 and mix with the fuel passing through the central passageway 13 to provide a pre-mix burner capable of producing a pre-mix or blue flame 26.

As will be evident to those of ordinary skill in the art based on the following disclosure, the collar 108 may be biased in the configuration 122 shown in FIG. 2 by a resilient member such as spring or the like. During the ignition stage, an actuating mechanism such as a hand operated lever or push button would enable the user to overcome the resilient member so than the collar 108 moves into the position 120 shown in FIG. 1. After the flint and wheel (or other igniter) ignite the flame, the actuating mechanism would be released and the collar 108 would automatically return to the configuration 122 of FIG. 2 where it operates as a pre-mix burner. As an alternative, the collar 108 can be moved back and forth between the two positions 120 and 122 manually. As a still further alternative, the burner may be biased to the post-mix configuration 120, and selectively operable to move to the pre-mix configuration 122.

Figure 3:
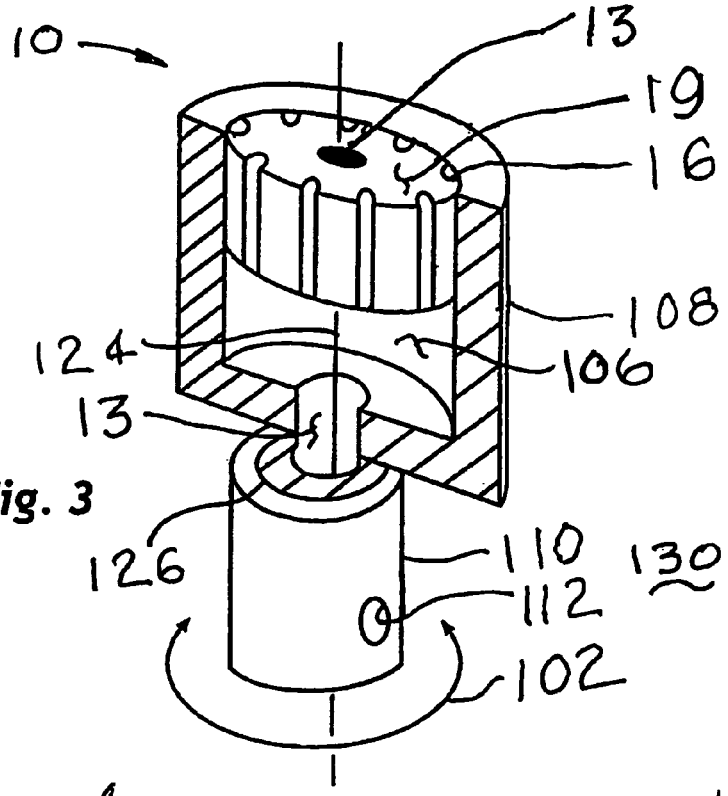
FIG. 3 is a simplified view partly in section of a second embodiment of the burner of the present invention.
Figure 4:
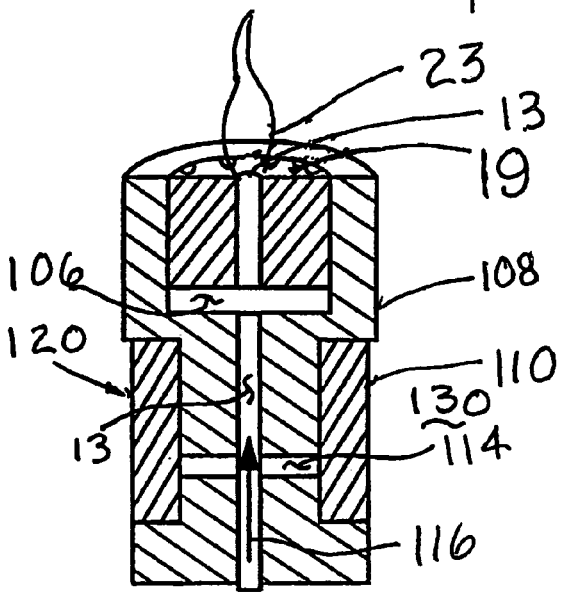
FIG. 4 is a section view of a burner corresponding to that of FIG. 3, shown in a post-mix configuration.
Figure 5:
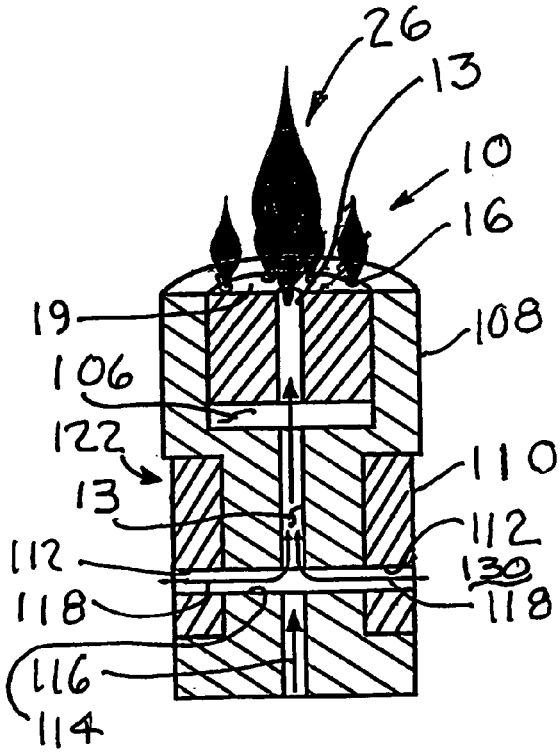
FIG. 5 is a section view of the burner corresponding to that of FIG. 3, except shown in a pre-mix configuration.

Turning to FIGS. 3, 4, and 5, an alternate embodiment of the invention includes a collar 110 that rotates in the direction of arrow 102 between a closed position (FIG. 3) and an open position (FIG. 4). The collar 110 is provided with a plurality of apertures 112 that are capable of rotating in and out of alignment with the air inlet channels 114. The arrow 102 indicates that collar 110 moves peripherally (more particularly collar 110 moves circumferentially) with respect to housing 108 and burner body 19. It is to be understood that while a cylindrical configuration for the collar 110 and a reduced diameter portion 126 is shown in FIGS. 3, 4, and 5, the collar 110 and portion 126 may have contiguous shapes other than cylindrical, while still permitting relative motion therebetween, to open and close the path between the air inlet apertures 112 in the collar 110 and the air inlet channels 114 in the housing 108. Specifically, "peripheral movement" here means movement of the apertures 112 into and out of alignment with channels 114, to open and close an airway path between the external air environment 130 and the central passageway 13.

With collar 110 in the first position 120, shown in FIG. 4, the airway path from the external air environment 130 to air inlet channels 114 is substantially blocked by peripheral or circumferential intentional misalignment of the air inlet apertures 112 with channels 114. In other words, a solid portion of collar 110 blocks off air from entering the channels 114, when the collar 110 is in the first position 120, as shown in FIG. 4. With the collar 110 in the first position 120, when fuel is delivered through the central passageway 13 and ignited, a yellow flame 23 will result. In the configuration 120 shown in FIG. 4, the burner 10 operates as a post-mix burner. The flint and striking wheel combination ignites the gas exiting the passageway 13 and draws oxygen from the air surrounding the exit to produce the post-mix yellow flame 23.

When the collar 110 is moved relative to housing 108, either circumferentially or peripherally, to the second position 122 shown in FIG. 5, and fuel is delivered through the central passageway 13, air from the external air environment 130 will enter the air inlet apertures 112 in the collar 110 and flow through the air inlet channels 114, after which it will mix with the fuel in the central passageway 13, after which it will pass through the burner body 19, both through central passageway 13 and through peripheral passageways 16. When ignited, the air and fuel mixture exiting burner body 19 will combust with a blue flame pattern 26. More particularly, the blue flame pattern 26 includes a principal blue flame at the exit of the central passageway 13, and (optionally) may include a plurality of auxiliary blue flames at the exits of the passageways 16 in the burner body 19.

In the configuration or position 122 shown in FIG. 5, the burner 10 operates as a pre-mix burner. With the collar 110 disposed in the position 122 shown in FIG. 5, air can travel from the external air environment 130 in the direction of arrows 118 to enter the air inlet apertures 112 and pass through the air inlet channels 114 to mix with fuel gas in the central passageway 13 prior to ignition.

As will be evident to those of ordinary skill in the art based on reading this disclosure, the rotating collar 110 may be biased to the position 122 shown in FIG. 5 by a resilient member such as a spring or the like. An actuating mechanism such as a lever or button may be utilized to overcome the force of the resilient member to move the collar into the position shown in FIG. 4 during ignition. After the gas is ignited by the flint and striking wheel or other igniter, the mechanism may be released and the collar automatically returned to the position shown in FIG. 5. As an alternative, the collar 110 may be rotated between the two positions manually. As a still further alternative, the burner 10 may be biased to the post-mix configuration 120, and selectively operable to move to the pre-mix configuration 122.

It may thus be seen that in FIGS. 1 and 4, air inlet apertures 112 in collar 110 are purposely misaligned with air inlet channels 114 in housing 108 in position 120, preventing air from entering and mixing with the fuel, indicated by arrow 116, in the central passageway 13. When the collar or choke 110 is moved relative to the burner body 19 and housing 108 to the position 122 shown in FIG. 2 or 5, air inlet apertures 112 are aligned with air inlet channels 114, permitting air to enter through the fluid communication path established with the external air environment 130, as indicated by arrows 118, where it mixes with the fuel indicated by arrow 116 in the central passageway 13.

Figure 7:
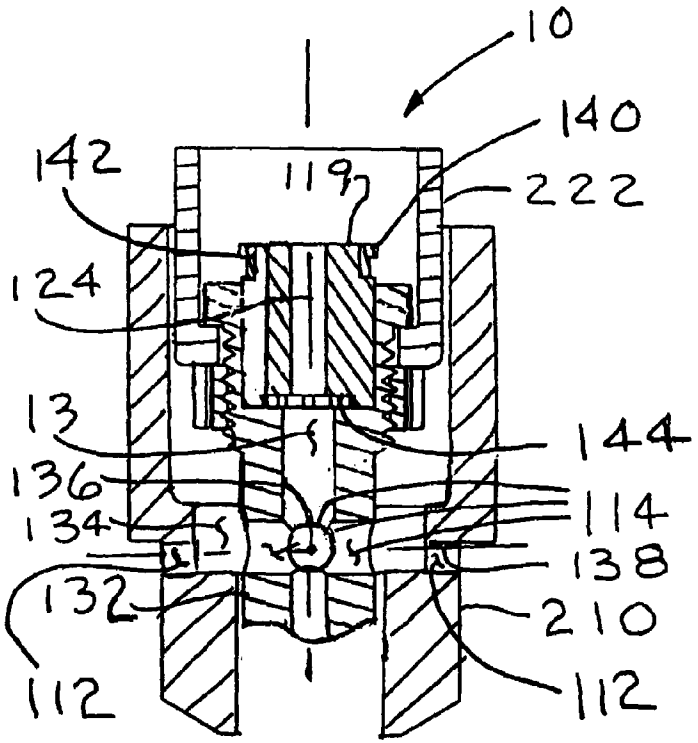
FIG. 7 is a view of the burner of FIG. 6, except shown in a pre-mix configuration.
Figure 6:
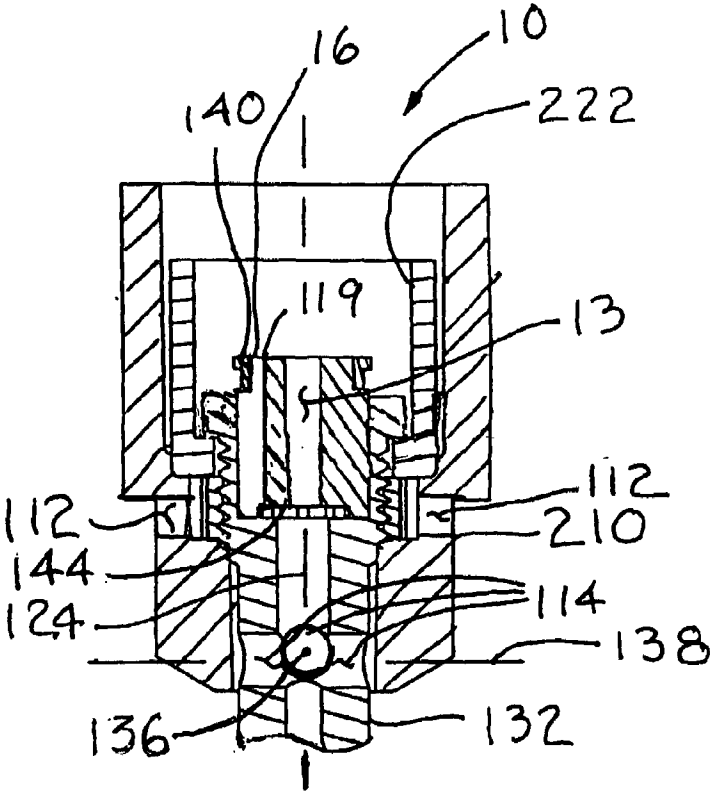
FIG. 6 is a more detailed view of a burner of the present invention according to the first embodiment shown in a post-mix configuration.
Figure 8:
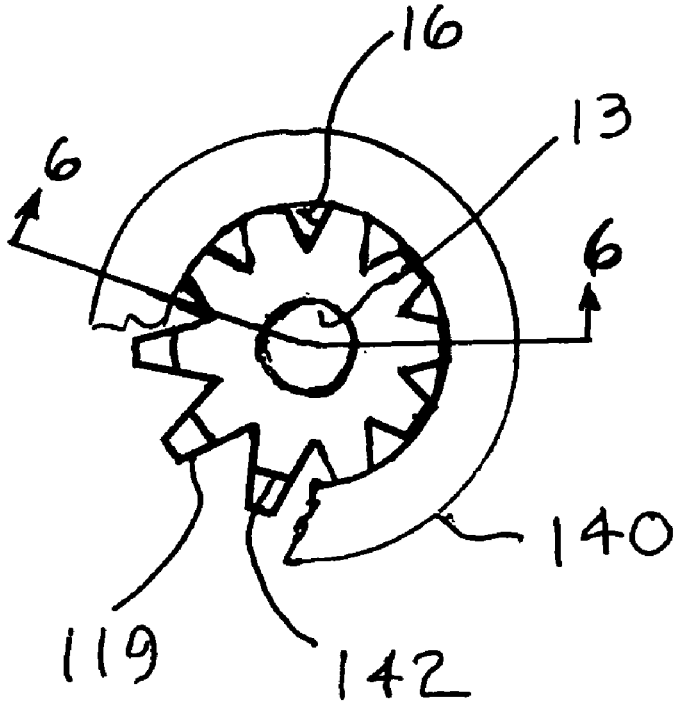
FIG. 8 is a top plan view of a burner body and partially cutaway view of a diffuser ring useful in the practice of the present invention.
Figure 9:
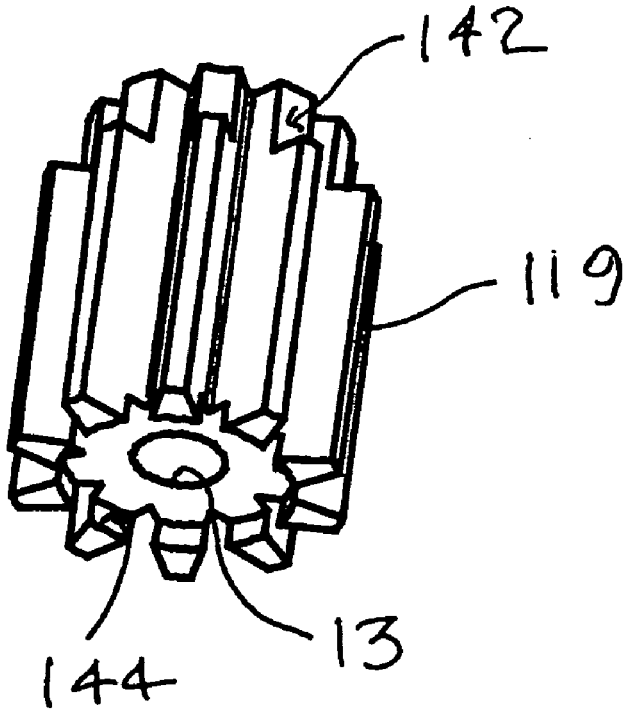
FIG. 9 is a perspective view of the burner body of FIG. 8.

Referring now to FIGS. 6, 7, 8, and 9, a more detailed view of the present invention according to the first embodiment may be seen. In FIG. 6, the burner 10 is in the first position or post-mix configuration 120 and will produce the yellow or "lazy" flame arrangement. In FIG. 7, the burner 10 is in the second position or pre-mix configuration 122 and will produce the blue or "torch" flame arrangement. FIG. 8 is a top view of a burner body 119 and a partially cutaway diffuser ring 140. The burner body 119 and diffuser ring 140 are shown in side section view in FIGS. 6 and 7 as taken along line 6—6 of FIG. 8. FIG. 9 shows a perspective view of the burner body 119.

In FIG. 6, an air control structure in the form of a collar 210 blocks the airway path from the external air environment 130 because the air inlet apertures 112 in collar 210 are not in fluid communication with the air inlet channels 114 in housing 132. In FIG. 7, the air inlet apertures 112 open the airway path from the external air environment 130 to the central or primary passageway 13 via chamber 134 and air inlet channels 114. It is to be understood that while air inlet apertures 112 are shown in FIGS. 6 and 7 aligned with an axis 138 of the air inlet channels 114, alternatively the air inlet apertures 112 may be located otherwise, for example, along an axis 136 perpendicular to the axis 138, with each of axes 136 and 138 perpendicular to the longitudinal axis 124. A burner body 119 (similar to the simplified burner body 19 shown in FIGS. 1–5) is provided with a diffuser ring 140. Diffuser ring 140 is preferably press-fit on a shoulder 142 of burner body 119. Burner body 119 is preferably gear-shaped (as may be seen more clearly in FIGS. 8 and 9) and has an internal counterbore 144 located at the upstream end thereof. The counterbore 144 provides fluid communication between central passageway 13 and peripheral passageways 16. In FIGS. 6 and 7, burner body 119, diffuser ring 140 and housing 132 together make up the burner or burner assembly for this embodiment.

In one aspect of the embodiment shown in FIGS. 6 and 7, auxiliary air may be permitted to enter the burner assembly radially inwardly at an auxiliary air inlet between a lower edge of the diffuser ring 140 and an upper edge of the housing 132. When present, the auxiliary air inlet is to be understood to be in fluid communication with the peripheral passageways 16. Alternatively, diffuser ring 140 may be elongated or repositioned to prevent entry of such auxiliary air by omitting the auxiliary air inlet from the burner assembly.

Figure 11:
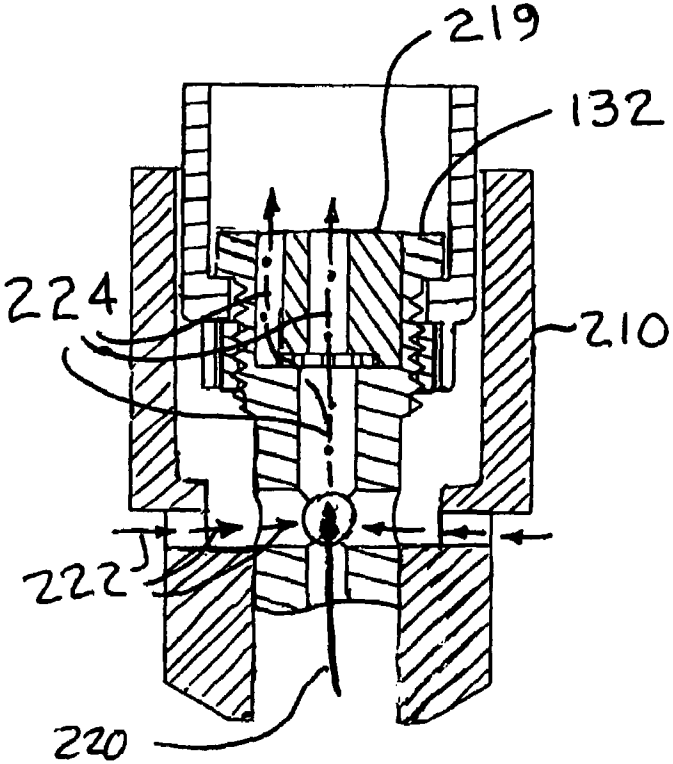
FIG. 11 is a view of the embodiment of FIG. 10, except shown in a pre-mix configuration.
Figure 10:
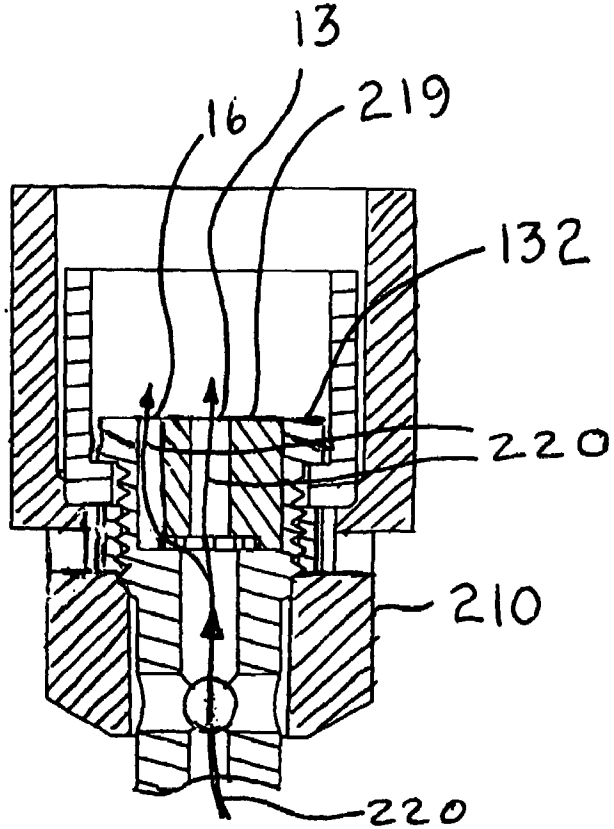
FIG. 10 is a view similar to that of FIG. 6, except for an embodiment having a burner assembly without a diffuser ring, shown in a post-mix configuration.

Referring now most particularly to FIGS. 10 and 11, an alternative embodiment of the present invention may be seen. In this embodiment, the diffuser ring is omitted, and the burner body 219 and housing 132 together make up the burner body assembly. In this embodiment, the burner body 219 may be the same as burner body 119 shown in FIGS. 6–9, except that the upper portion forming shoulder 142 may be removed. In addition, the counterbore 144 on the bottom of the burner body 219 may also be omitted, provided that a clearance is provided below the burner body 219 and housing 132.

Figure 12:
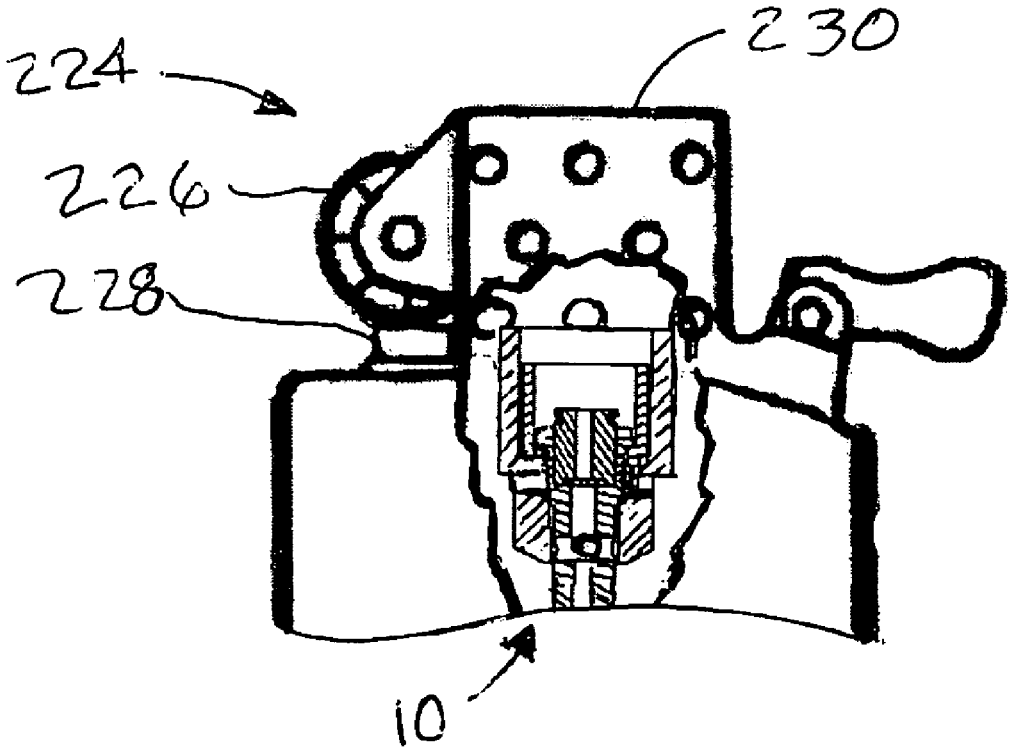
FIG. 12 is a view of the embodiment of FIG. 10 shown with the flint and wheel ignition system.

Referring now to FIG. 12, a burner 10 according to the present invention is shown in a cut away view of the lighter of U.S. Pat. No. 6,247,920. In FIG. 12, a flint and wheel ignition system 224 includes a flint wheel 226 and a flint 228. A windscreen 230 surrounds the area above the burner 10. In FIG. 12, the burner 10 is shown in the post-mix configuration in which rotation of the flint wheel 226 will cause sparks from the flint 228 to ignite a yellow post-mix flame in the area above the burner 10 surrounded by the windscreen 230, when fuel is provided to burner 10 by a gas valve (not shown). After ignition, the burner 10 may be shifted to the pre-mix configuration to provide a blue flame, as described above.

Figure 13:
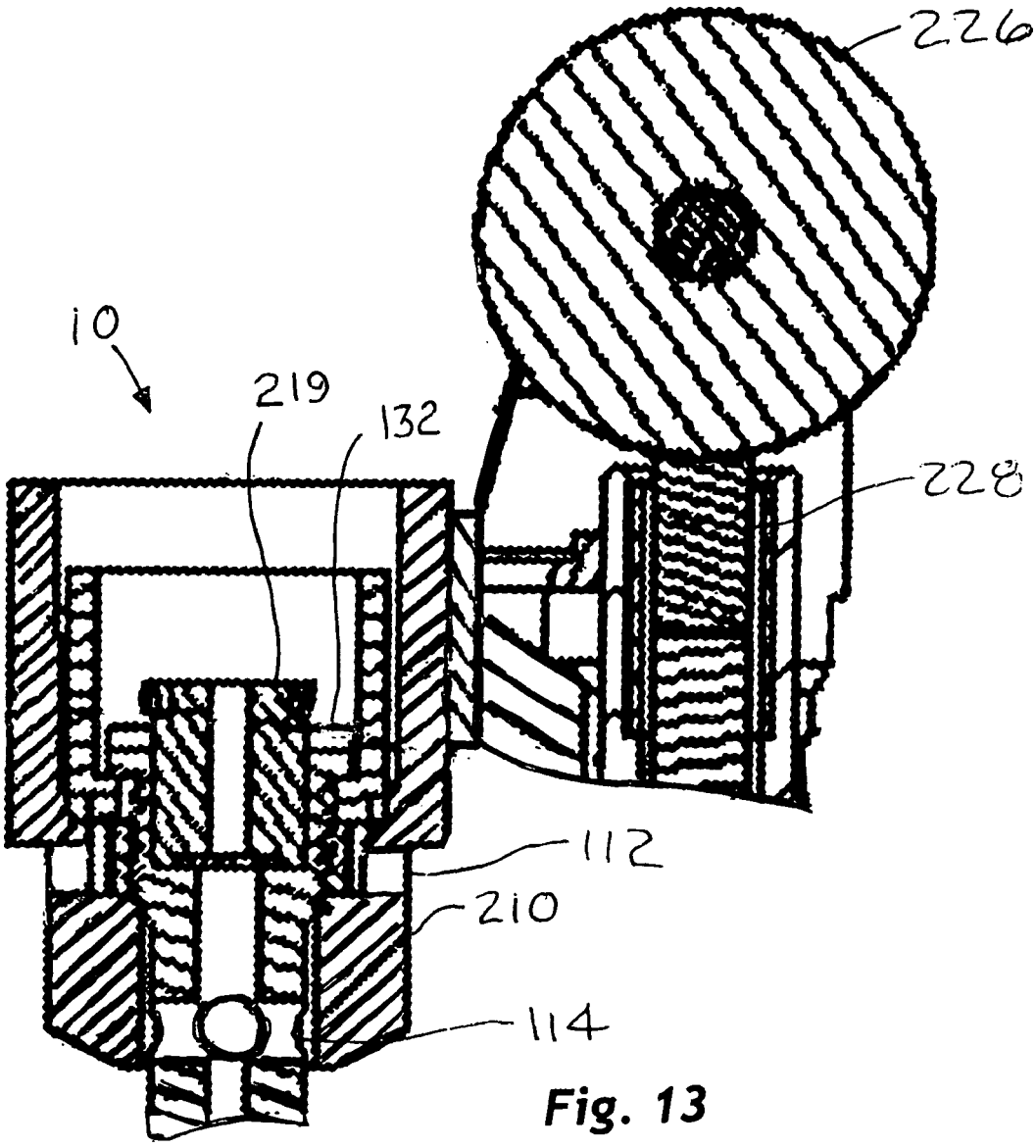
FIG. 13 is an enlarged view of the embodiment of FIG. 10 shown with another flint and wheel ignition system.

Referring now to FIG. 13, burner 10 is shown with the flint wheel 226 and flint 228 in an enlarged and more detailed view. As with FIG. 12, the burner is shown in a post-mix configuration. When fuel is provided to burner 10, sparks from flint 228 caused by rotation of wheel 226 will ignite a yellow flame at burner 10, after which the burner 10 may be shifted to the pre-mix configuration.

Figure 14:
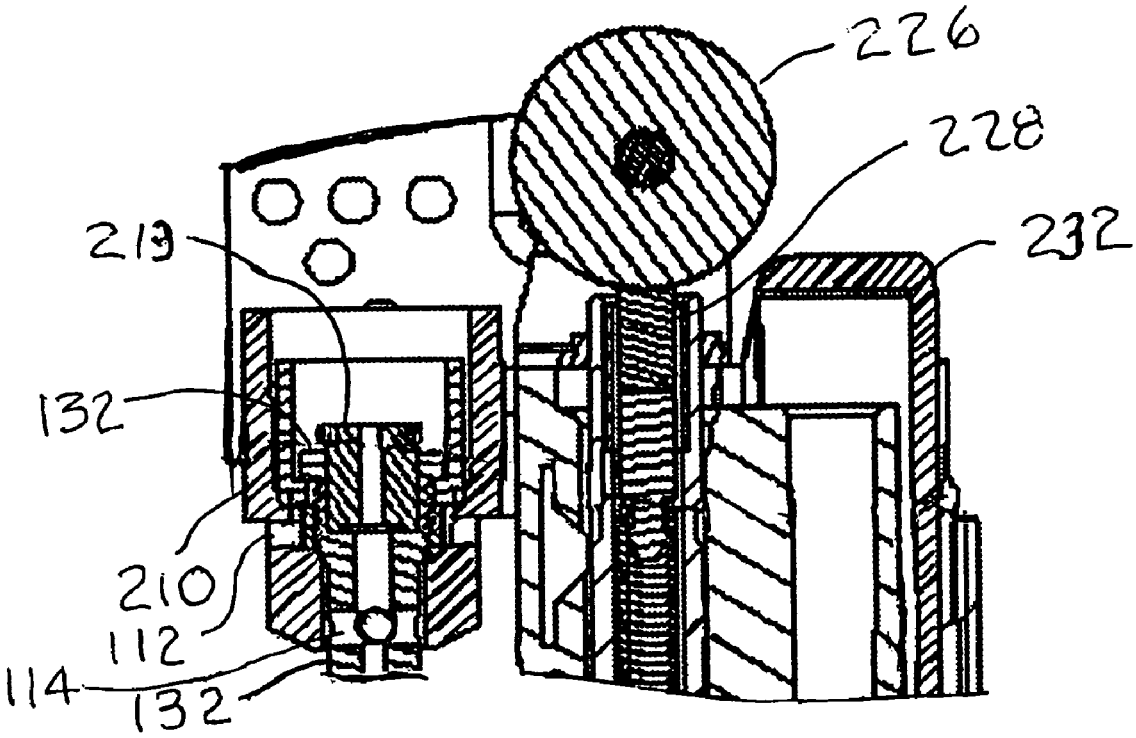
FIG. 14 is a view similar to that of FIG. 13, except with additional parts of the lighter shown to illustrate a way of switching the burner from a post-mix configuration to a pre-mix configuration.

Referring now to FIG. 14, additional details of the operation of the present invention may be seen. In the view shown in FIG. 14, a pushbutton 232 is formed as an extension of or connection to the collar 210. As the user's thumb is rotating wheel 226, it will begin depression of pushbutton 232 opening a gas valve (not shown) to supply fuel to burner 10 in the post-mix configuration. Sparks from flint 228 will ignite a yellow flame at the outlet of burner 10. Continued travel of pushbutton 232 will move collar 210 with respect to housing 132 to align the air inlet apertures 112 with the air inlet channels 114, converting burner 10 to a pre-mix configuration, such as that shown in FIG. 7 or 11. Release of pushbutton 232 will stop delivery of fuel to the burner 10, and allow the burner 10 to return to the post-mix configuration.

In the embodiments shown, it may be noted that the burner body and housing together make up a burner body assembly. The burner body assembly may also include a diffuser ring. Once assembled, the burner body assembly or burner preferably forms a unitary structure and the relative movement to achieve the post-mix and pre-mix configurations is preferably between the collar or other air control structure and the burner body assembly for such embodiments of the present invention. In FIGS. 10 and 11, fuel flow is indicated by solid arrows 220, air flow is indicated by dashed arrows 222, and air-fuel mixture flow is indicated by dot-dashed arrows 224. It is to be understood that the flow paths indicated in FIGS. 10 and 11 are applicable to FIGS. 6 and 7. In FIG. 10 a post-mix configuration is shown in which air will combine with the fuel only after the fuel exits the burner body 219, resulting in a yellow or "lazy" flame type combustion once ignited. In FIG. 11 a pre-mix configuration is shown in which air combines with fuel within the burner body assembly before it exits the burner body, resulting in a blue or "torch" flame type combustion once ignited.

In contrast to some prior art designs, the burner of the present invention may be distinguished by the absence of air inlets to the burner in the post-mix configuration. In the practice of the present invention only air mixing from the environment adjacent the exit or outlet of the burner is relied upon for combustion of the yellow flame. While clearance is shown between the housing 132 and collar 210 in FIGS. 6 and 10, it is to be understood that such clearance is insufficient to admit air to the air inlet channels 114 to support pre-mix combustion with in the position or configuration shown in FIGS. 6 and 10. In the practice of the present invention the combustion chamber made up of the burner body 119 and surrounding sleeve 222 is entirely closed off except for except for passages 13 and 16.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims. For example and not by way of limitation, while separate longitudinal and circumferential movement between the collar and the burner body or housing has been described above, it is also contemplated that a combined movement, such as helical or sequential longitudinal and circumferential or peripheral movements may be used while still remaining within the scope of and practicing the claimed present invention wherein a single burner is operable in either a post-mix or a pre-mix configuration. Furthermore by way of example and not by way of limitation, the central passageway may be made up of a primary passageway that is not centered, or by a plurality of passageways, provided that there is at least one passageway selectively connected to the source of combustible fuel. Similarly, only one selectively openable air inlet aperture in fluid communication with the fuel passageway is necessary for the practice of the present invention, notwithstanding that various embodiments show multiple air inlet apertures.

What is claimed is:

1. A combustible fuel lighter comprising:

a. a burner and air control structure, the burner having an outlet connected to at least one passageway therethrough, the at least one passageway selectively connected to a source of fuel, the burner further having at least one air inlet in fluid communication with the at least one passageway, and the air control structure adjacent at least a part of the burner, wherein the air control structure and burner are movable relative to each other and positionable to a first position wherein ambient air is substantially blocked from entering the at least one air inlet, and further positionable to a second position wherein ambient air enters the at least one air inlet such that when the at least one passageway is connected to a source of combustible fuel, the burner assembly forms a post-mix configuration when the air control structure and burner are in the first position, and the burner assembly forms a pre-mix configuration when the air control structure and burner are in the second position, wherein the burner and air control structure is biased to the first position;

b. an igniter positioned adjacent to the burner; and c. an actuating mechanism positioned adjacent to the igniter, the actuating mechanism including an actuating portion located on a side of the igniter opposite the burner and operably connected to at least one of the burner and air control structure, whereby actuation of the actuating portion of the actuating mechanism positions the burner and air control structure to the second position.

2. The lighter of claim 1 wherein the actuating portion comprises a contact surface.

3. The lighter of claim 2 wherein the contact surface comprises a pushbutton.

4. The lighter of claim 1 wherein the air control structure comprises a collar surrounding at least a part of the burner.

5. The lighter of claim 4 wherein the burner has a longitudinal axis colinear with the passageway and the relative movement between the collar and burner is at least partially in a direction parallel to the longitudinal axis.

6. The lighter of claim 4 wherein the burner has a periphery surrounding the passageway and the relative movement between the collar and burner is along at least a portion of the periphery of the burner.

7. The lighter of claim 4 wherein the burner has a longitudinal axis colinear with the passageway and the relative movement between the collar and burner is at least partially circumferential to the longitudinal axis.

8. The lighter of claim 1 wherein the fuel includes one or more hydrocarbons.

9. The lighter of claim 8 wherein the fuel includes one or more alkane hydrocarbons.

10. A lighter assembly comprising:

a. a burner body assembly including a burner body and a housing, the assembly having an outlet connected to a passageway therethrough for selectable connection to a source of fuel;

b. an air control structure at least partially surrounding the burner body assembly, wherein the air control structure and burner body assembly are movable relative to each other, and positionable to a first position wherein fuel is admitted to the passageway and ambient air is substantially blocked from entering the passageway, and a second position wherein fuel is admitted to the passageway and ambient air enters the passageway and mixes with the fuel therein such that the burner body assembly and air control structure form a post-mix configuration in the first position, and the burner assembly and air control structure form a pre-mix configuration in the second position, a resilient member biasing at least one of the air control structure and burner body assembly to the first position;

c. an igniter located adjacent the burner body assembly such that sparks from the igniter are directed to the outlet of the burner body assembly at least when the burner body assembly and air control structure are in the first position; and d. an actuating mechanism operably coupled to at least one of the air control structure and burner body assembly, wherein the actuating mechanism includes an actuating portion located on a side of the igniter opposite the burner body assembly, wherein actuation of the actuating portion of the actuating mechanism positions the air control structure and burner body assembly to the second position.

11. The assembly of claim 10 further comprising an air inlet having a fluid connection selectively connectable to the passageway, wherein the fluid connection between the passageway and the air inlet is substantially blocked in the first position, and the fluid connection between the passageway and the air inlet is opened in the second position.

12. The assembly of claim 10 wherein the burner body assembly has a longitudinal axis colinear with the passageway and the relative movement between the air control structure and burner body assembly is at least partially in a direction parallel to the longitudinal axis.

13. The assembly of claim 10 wherein the burner body assembly has a periphery surrounding the passageway and the relative movement between the air control structure and burner body assembly is along at least a portion of the periphery of the burner body assembly.

14. The assembly of claim 10 wherein the burner body assembly has a longitudinal axis colinear with the passageway and the relative movement between the air control structure and burner body assembly is at least partially circumferential to the longitudinal axis.

15. A method of igniting a single burner of a lighter in a post-mix configuration and thereafter transforming the burner to a pre-mix configuration, the method comprising the steps of:

a. providing a burner having a passageway therethrough and an air inlet in fluid communication with the passageway;

b. providing an air control structure surrounding at least a part of the burner having the air inlet therein;

c. positioning the burner and air control structure to a first relative position wherein the air control structure substantially blocks air from entering the air inlet such that the burner and air control structure form a post-mix configuration wherein fuel passing through the passageway is not mixed with air until after the fuel exits the burner;

d. igniting fuel exiting the burner with an ignition system while the burner and air control structure are in the first relative position, the ignition system activated by a user's digit; and e. thereafter positioning the burner and air control structure to a second relative position by activating an actuating mechanism positioned adjacent to the ignition system using subsequent motion of the same digit, wherein the air control structure permits air to enter the air inlet and mix with fuel passing through the passageway such that the burner and air control structure form a pre-mix configuration wherein fuel passing through the passageway is mixed with air before exiting the burner.

16. The method of claim 15 wherein the passageway comprises a primary passageway and the burner includes a burner body having one or more peripheral passageways at a periphery thereof in fluid communication with the primary passageway, and step e. further includes opening a fluid connection between the air inlet and the primary and peripheral passageways.

17. The method of claim 15 wherein step e. comprises causing relative movement between the air control structure and the burner.

18. The method of claim 17 wherein the passageway is aligned with a longitudinal axis and the movement is aligned at least in part with the longitudinal axis.

19. The method of claim 17 wherein the movement is peripheral to the burner.

20. The method of claim 17 wherein the primary passageway is aligned with a longitudinal axis and the movement is at least in part circumferential to the longitudinal axis.

21. The method of claim 15 wherein the user's digit comprises a thumb.

22. A method of igniting a single burner of a lighter using a flint and wheel with the burner in a post-mix configuration and subsequently operating the burner in a pre-mix configuration wherein a flame is projected from the lighter in both the post-mix and pre-mix configurations, the method comprising the steps of:

a. providing a burner body assembly having a burner body and housing, the assembly having a primary passageway therethrough;

b. providing a collar surrounding at least a part of the burner body assembly;

c. causing a first relative position between the collar and the burner body assembly wherein the collar substantially blocks air from entering the primary passageway such that the burner body assembly and collar form a post-mix configuration wherein fuel passing through the primary passageway is not mixed with air until after the fuel exits the burner body;

d. rotating a wheel of a flint and wheel igniter to ignite the fuel exiting the burner to create a post-mix flame above the burner; and e. subsequently causing a second relative position between the collar and the burner body assembly by travel of the actuation mechanism wherein the collar in the second relative position permits air to enter the primary passageway such that the burner body assembly and collar form a pre-mix configuration wherein fuel passing through the primary passageway is mixed with air before exiting the burner body, converting the post-mix configuration to the pre-mix configuration.

23. The method of claim 22 wherein the burner body assembly includes one or more peripheral passageways and air is permitted to be in fluid communication with the peripheral passageways at least in step e.

24. The method of claim 22 wherein step e. comprises causing relative movement between the collar and the burner body assembly.

25. The method of claim 24 wherein the primary passageway is aligned with a longitudinal axis and the movement is aligned at least in part with the longitudinal axis.

26. The method of claim 24 wherein the movement is peripheral to the burner body assembly.

27. The method of claim 24 wherein the primary passageway is aligned with a longitudinal axis and the movement is at least in part circumferential to the longitudinal axis.

28. A method of making a burner for a lighter capable of operating initially in post-mix configuration for ignition using a flint and wheel igniter and wherein the burner is capable of transforming to a pre-mix configuration after ignition, the method comprising the steps of:

a. providing a burner body assembly having at least a burner body, the assembly having a primary passageway therethrough and connected to an exit, with a part of the burner body assembly having at least one air inlet channel in fluid communication with the primary passageway;

b. providing a collar sized to closely interfit with at least the part of the burner body assembly having the at least one air inlet channel;

c. assembling the burner body assembly and the collar together in a loose fitting relationship so that the burner body assembly is movable after assembly relative to the collar to substantially block air from an external air environment through the at least one air inlet channel to the primary passageway when the burner body assembly and collar are in a first relative position, and selectively admits air from the external air environment through the at least one air inlet channel to the primary passageway when the burner body assembly and collar are in a second relative position; and d. providing a flint and wheel ignition system adjacent the burner body such that sparks from the flint are directed toward the fuel after it leaves the exit of the burner body while the burner body assembly and collar are in the first relative position, the flint and wheel ignition system actuatable by a user's thumb; and e. providing an actuating mechanism including a protruding portion extending from the lighter on a side of the flint and wheel igniter opposite the burner body assembly, wherein the protruding portion of the actuating mechanism is actuatable by movement of the same thumb such that the burner body assembly and collar are arranged in the second relative position when the actuating mechanism is actuated.

29. A lighter comprising:

a. a burner and air control structure including:

i. a burner body assembly having a burner body and a housing supporting the burner body and forming the burner, the burner body assembly having a central passageway therethrough for directing fuel to the burner, and the housing having an air inlet channel in fluid communication with the central passageway, ii. a collar forming the air control structure surrounding at least a part of the burner body assembly having the air inlet channel and wherein the collar has an air inlet aperture movable into and out of registration with the air inlet channel in the housing by relative movement between the burner body assembly and the collar to substantially block and unblock fluid communication between the air inlet channel and an external air environment such that the burner is convertible from a post-mix configuration when the fluid communication is substantially blocked to a pre-mix configuration when the fluid communication is unblocked; and b. a flint and wheel ignition system including a flint wheel and flint operable to direct sparks from the flint to the fuel after it leaves the central passageway while the burner and air control structure are in the post-mix configuration and;

c. an actuating mechanism positioned adjacent to the flint and wheel ignition system, the actuating mechanism including a user-activatable portion on a side of the ignition system opposite the burner body assembly, the actuating mechanism operably attached to at least one of the burner body assembly and the collar such that user activation of the actuating mechanism converts the lighter from the post-mix configuration to the pre-mix configuration.

30. The lighter of claim 29 wherein the central passageway has a longitudinal axis and the relative movement between the burner body assembly and the collar is colinear with the longitudinal axis.

31. The lighter of claim 29 wherein the burner body is generally gear-shaped and the burner body assembly includes a diffuser ring received on the burner body to define a plurality of peripheral passageways therebetween.

32. The lighter of claim 29 wherein the burner body assembly includes a plurality of peripheral passageways and an auxiliary air inlet in fluid communication with the peripheral passageways.

33. The lighter of claim 29 wherein the burner body is generally gear-shaped and the burner body is received in the housing to define a plurality of peripheral passageways therebetween, wherein the peripheral passageways are in fluid communication with the central passageway.

* * * * *

UNITED STATES PATENT AND TRADEMARK OFFICE

CERTIFICATE OF CORRECTION

PATENT NO. : 7,214,055 B2
APPLICATION NO. : 10/974775
DATED : May 8, 2007
INVENTOR(S) : Ronald J. Meister et al.

It is certified that error appears in the above-identified patent and that said Letters Patent is hereby corrected as shown below:

Title Page, item

(56) References Cited:

remove the following references:

| | | |
|---|---|---|
| 718,714 | 3,149,623 | 4,178,844 |
| 1,054,188 | 3,330,204 | D256,316 |
| 1,309,049 | 3,450,025 | 4,475,528 |
| 1,435,747 | D243,436 | 4,553,523 |
| 2,631,579 | 4,109,567 | |

replace “EP” with -- GB -- for foreign patent no. 1 452 264

Page 2 remove the following references:

| | | |
|---|---|---|
| 4,589,399 | 5,452,706 | 6,279,467 |
| 4,920,950 | D370,387 | 6,457,594 |
| 4,977,824 | 5,713,344 | 6,546,851 |
| 5,133,333 | 6,131,560 | 6,681,759 |
| 5,287,844 | 6,135,014 | |

Signed and Sealed this

First Day of April, 2008

JON W. DUDAS
*Director of the United States Patent and Trademark Office*